US006517327B2

(12) United States Patent
Beyer et al.

(10) Patent No.: US 6,517,327 B2
(45) Date of Patent: Feb. 11, 2003

(54) FUEL PUMP ISOLATION ASSEMBLY

(75) Inventors: Sharon Elizabeth Beyer, Grand Blanc, MI (US); Dale Richard Jones, Flushing, MI (US); Matthew L. Catlin, Flushing, MI (US); Mohammed Aslam, Flint, MI (US); Mark K. Wolfenden, Burton, MI (US)

(73) Assignee: Delphi Technologies Inc., Troy, MI (US)

( * ) Notice: Subject to any disclaimer, the term of this patent is extended or adjusted under 35 U.S.C. 154(b) by 17 days.

(21) Appl. No.: 09/746,545

(22) Filed: Dec. 15, 2000

(65) Prior Publication Data

US 2002/0007825 A1 Jan. 24, 2002

Related U.S. Application Data

(60) Provisional application No. 60/171,231, filed on Dec. 16, 1999.

(51) Int. Cl.[7] ..... F04B 35/04; F02M 37/10

(52) U.S. Cl. ..... 417/363; 123/509

(58) Field of Search ..... 123/509; 417/363

(56) References Cited

U.S. PATENT DOCUMENTS

| | | | | | |
|---|---|---|---|---|---|
| 3,968,896 | A | | 7/1976 | Giacoletti et al. | 220/723 |
| 4,852,761 | A | | 8/1989 | Turner et al. | 220/746 |
| 4,964,787 | A | * | 10/1990 | Hoover | 417/363 |
| 4,971,017 | A | * | 11/1990 | Beakley et al. | 123/509 X |
| 5,002,467 | A | * | 3/1991 | Talaski et al. | 417/363 |
| 5,038,741 | A | * | 8/1991 | Tuckey | 123/509 |
| 5,218,942 | A | | 6/1993 | Coha et al. | 123/514 |
| 5,482,444 | A | * | 1/1996 | Coha et al. | 417/363 |
| 5,660,206 | A | | 8/1997 | Neal et al. | 137/592 |
| 5,797,376 | A | * | 8/1998 | Frank et al. | 123/509 |

FOREIGN PATENT DOCUMENTS

| | | | | |
|---|---|---|---|---|
| JP | 63-263294 | * | 10/1988 | 417/423.3 |

* cited by examiner

*Primary Examiner*—Tony M. Argenbright
(74) *Attorney, Agent, or Firm*—Vincent A. Cichosz

(57) ABSTRACT

A fuel pump isolation assembly for a fuel pump of a vehicle includes a fuel pump and an isolation housing having a fuel pump cavity extending axially therethrough to receive the fuel pump. The fuel pump isolation assembly also includes a plurality of flex arms extending from the isolation housing and into the fuel pump cavity to engage the fuel pump and allow radial movement of the fuel pump during its operation.

19 Claims, 7 Drawing Sheets

FUEL PUMP ISOLATION ASSEMBLY

CROSS-REFERENCE TO RELATED APPLICATION(S)

The present invention claims the priority date of co-pending U.S. Provisional Patent Application Ser. No. 60/171,231, filed Dec. 16, 1999.

TECHNICAL FIELD

The present invention relates generally to fuel pumps for vehicles and, more particularly, to a fuel pump isolation assembly for a fuel tank of a vehicle.

BACKGROUND OF THE INVENTION

It is known to provide a fuel tank in a vehicle to hold fuel to be used by an engine of the vehicle. It is also known to provide a fuel pump to pump fuel from the fuel tank to the engine. Typically, the fuel pump is disposed inside the fuel tank. One type of fuel pump is known as a high-pressure turbine fuel pump. The high-pressure turbine fuel pump typically includes an impeller rotatable between inlet and outlet plates. The high-pressure turbine fuel pump is typically isolated relative to the fuel tank by rubber isolators. However, the rubber isolators are extra components and cost, both of which are undesired.

Therefore, it is desirable to isolate a fuel pump for a vehicle without the need of rubber isolators. It is also desirable to isolate fuel pumps of different diameters with a single isolation assembly. It is further desirable to provide low cost isolation for a fuel pump.

SUMMARY OF THE INVENTION

It is, therefore, one object of the present invention to provide a fuel pump isolation assembly for a fuel tank of a vehicle.

It is another object of the present invention to provide a fuel pump isolation assembly for a fuel tank of a vehicle that isolates fuel pumps with different diameters.

It is a further object of the present invention to provide a fuel pump isolation assembly for a fuel tank of a vehicle that isolates a fuel pump and eliminates the use of rubber isolators.

To achieve the foregoing objects, the present invention is a fuel pump isolation assembly for a fuel tank of a vehicle including a fuel pump and an isolation housing having a fuel pump cavity extending axially therethrough to receive the fuel pump. The fuel pump isolation assembly also includes a plurality of flex arms extending from the isolation housing and into the fuel pump cavity to engage the fuel pump and allow radial movement of the fuel pump during its operation.

One advantage of the present invention is that a fuel pump isolation assembly is provided for a fuel tank of a vehicle. Another advantage of the present invention is that the fuel pump isolation assembly has a retainer or isolation housing that will provide adequate radial and axial movement to achieve a desired isolation of the fuel pump. Yet another advantage of the present invention is that the fuel pump isolation assembly has enhanced performance because the fuel pump is isolated and will not transmit noise/vibrations to the fuel tank. Still another advantage of the present invention is that the fuel pump isolation assembly provides flexibility to package fuel pumps with different diameters. A further advantage of the present invention is that the fuel pump isolation assembly isolates the fuel pump at reduced cost because no additional rubber isolators are needed. Yet a further advantage of the present invention is that fuel pump isolation assembly achieves similar noise isolation performance as conventional designs with no added components. Still a further advantage of the present invention is that the fuel pump isolation assembly saves both material content and labor. Another advantage of the present invention is that the fuel pump isolation assembly reduces tooling investment because it will package fuel pumps with different diameters.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
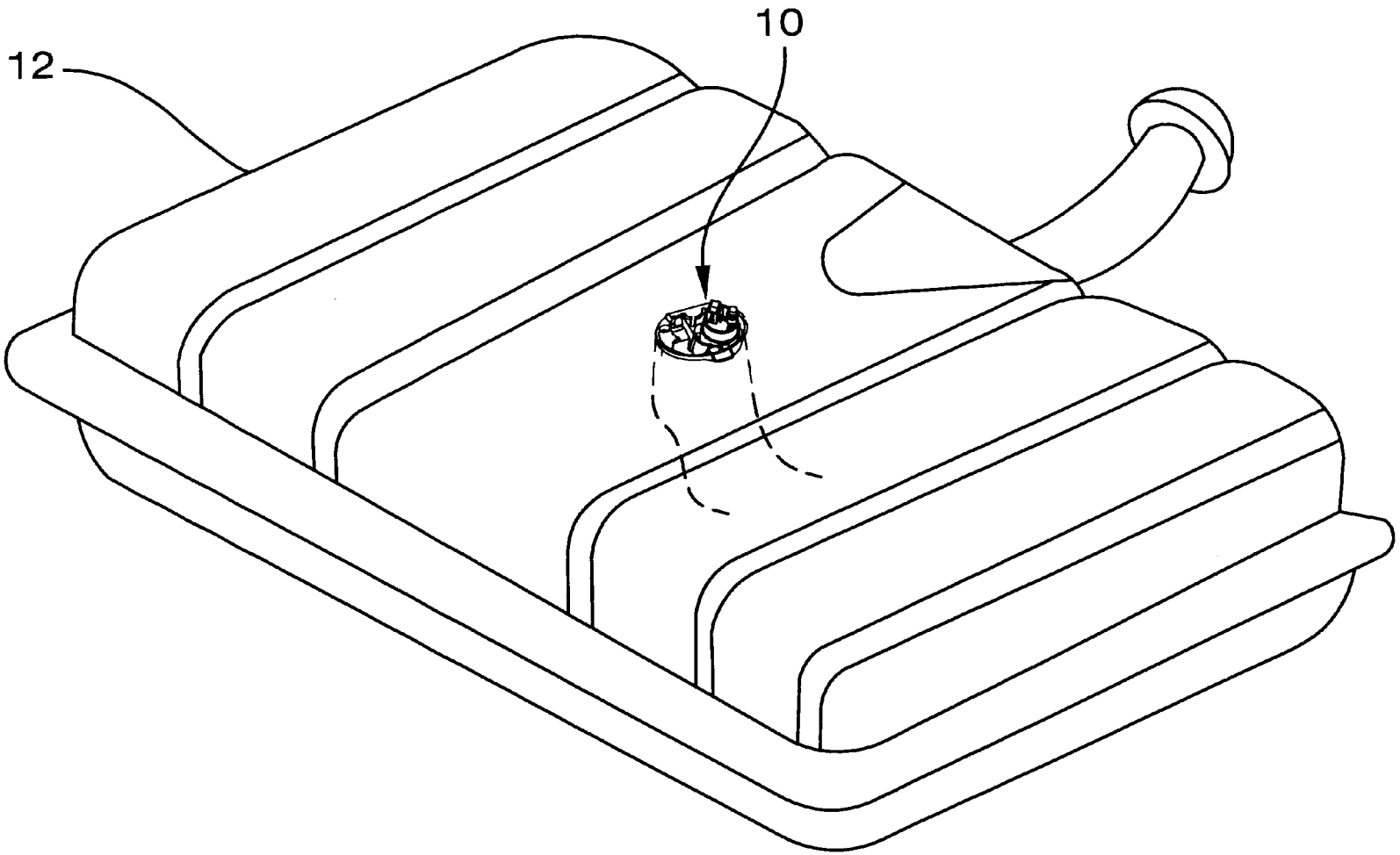
FIG. 1 is a perspective view of a fuel pump isolation assembly, according to the present invention, illustrated in operational relationship with a fuel tank.
Figure 2:
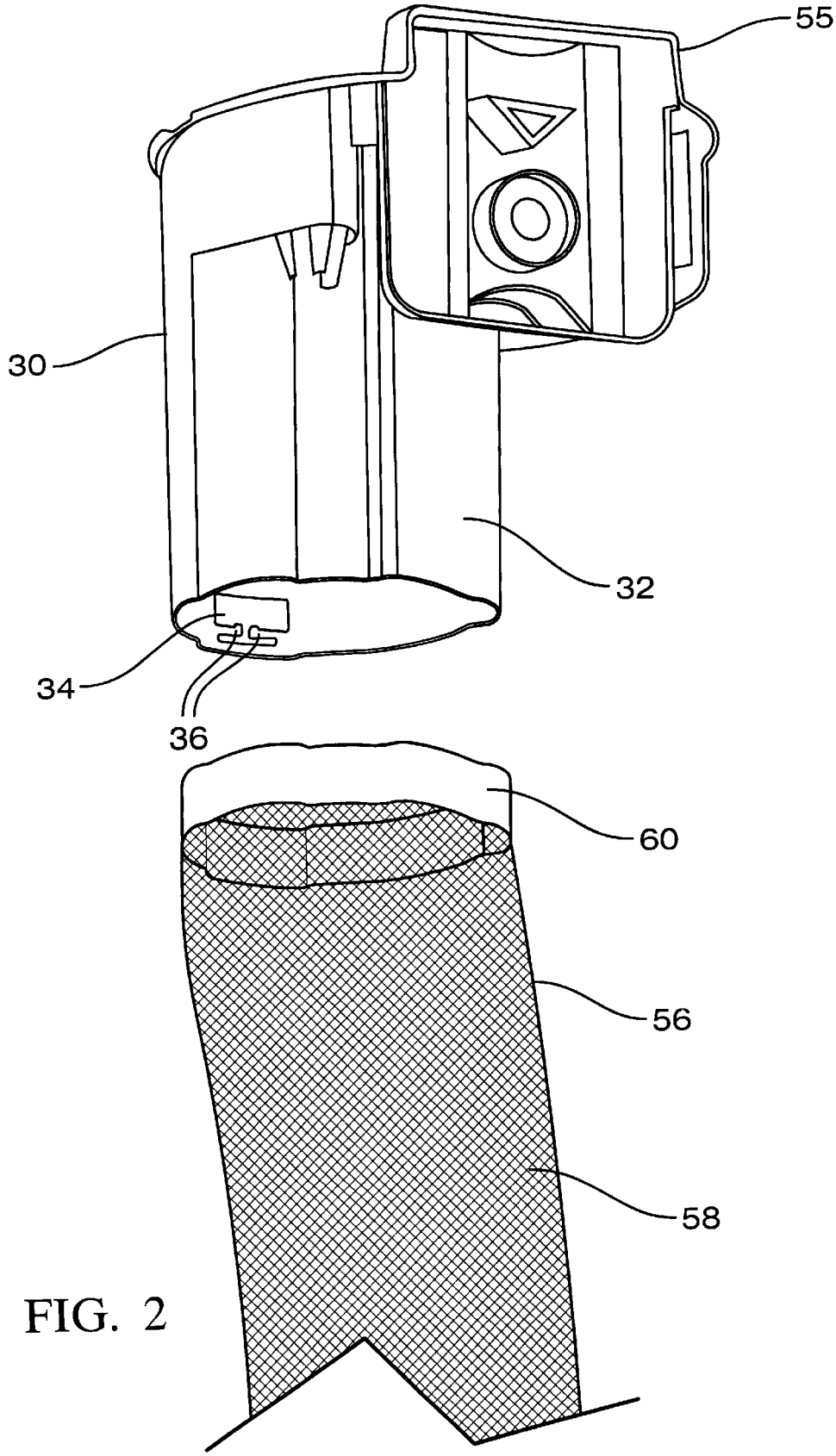
FIG. 2 is an exploded perspective view of a isolation housing and a fuel strainer of the fuel pump isolation assembly of FIG. 1.
Figure 3:
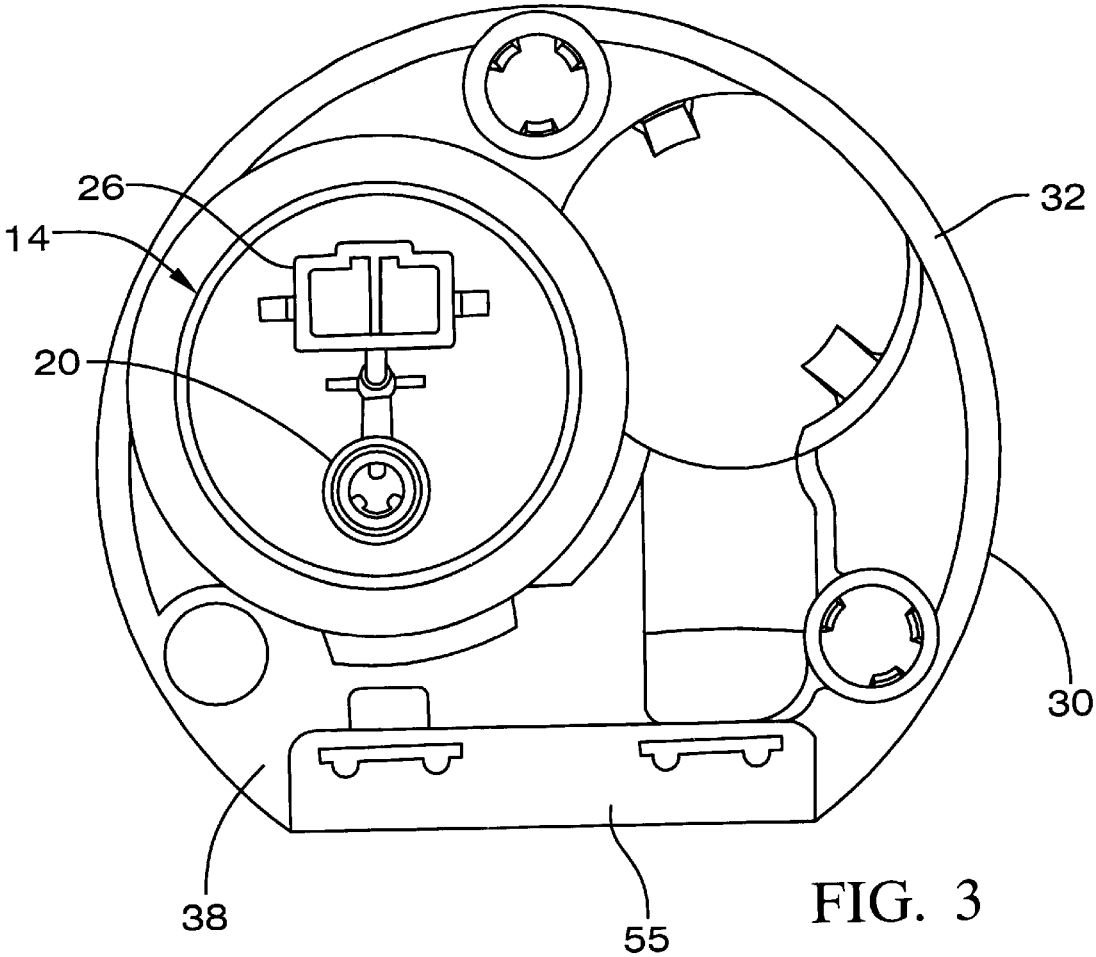
FIG. 3 is a plan view of the fuel pump isolation assembly of FIG. 2.

Referring to the drawings and in particular FIG. 1, one embodiment of a fuel pump isolation assembly 10, according to the present invention, is shown for a fuel tank 12 of a vehicle (not shown). The fuel pump isolation assembly 10 is disposed inside the fuel tank 12. It should be appreciated that the fuel tank 12 is conventional and known in the art.

Figure 4:
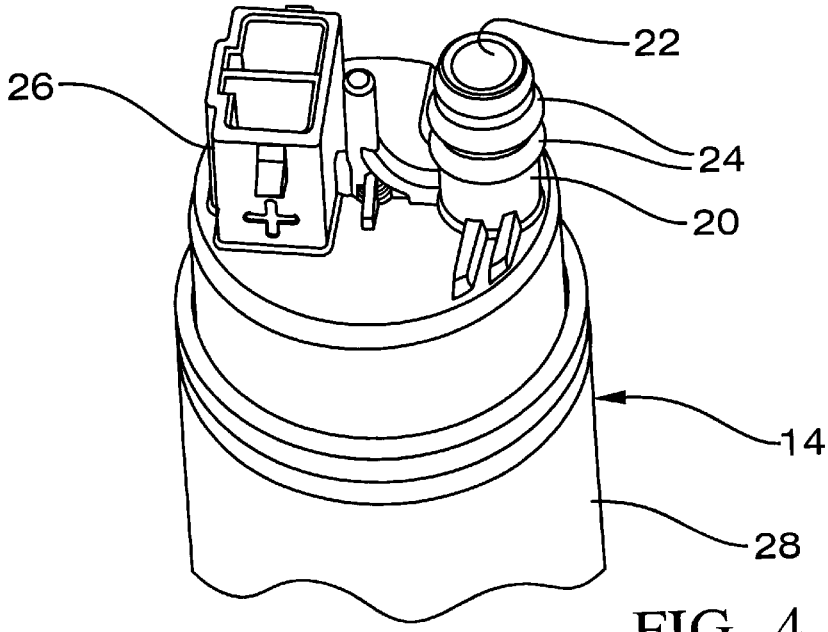
FIG. 4 is a partial perspective view of a fuel pump of the fuel pump isolation assembly of FIG. 1.
Figure 5:
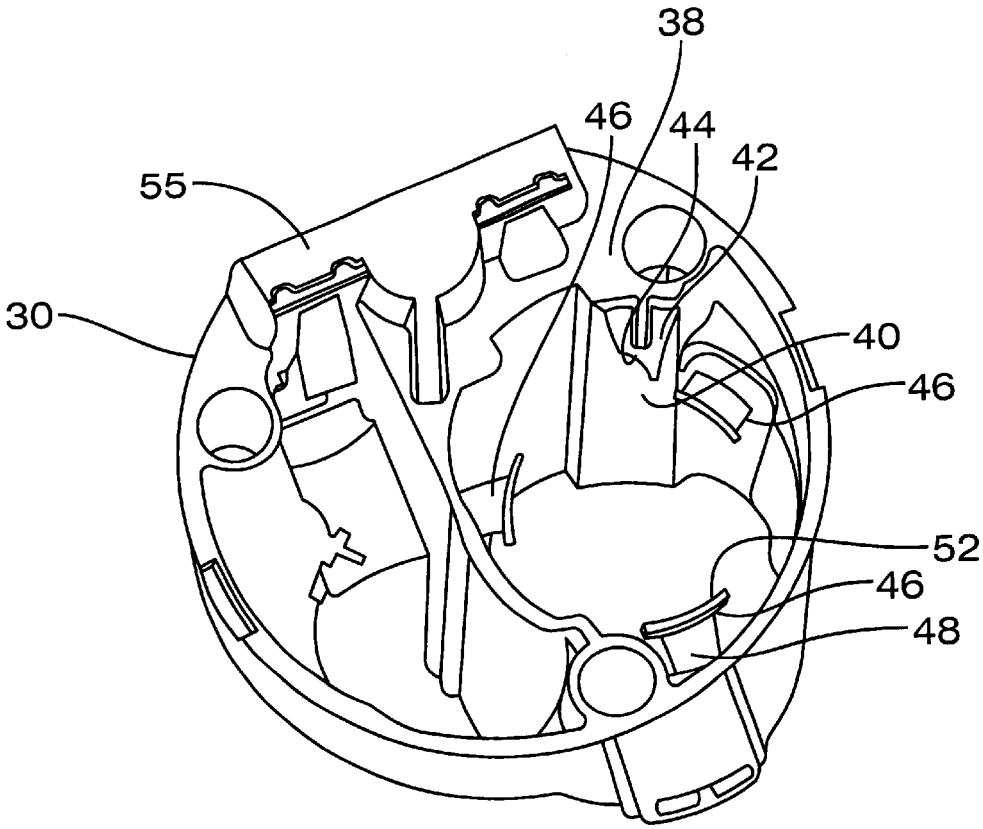
FIG. 5 is a perspective view of the isolation housing of the fuel pump isolation assembly of FIG. 1.
Figure 6:
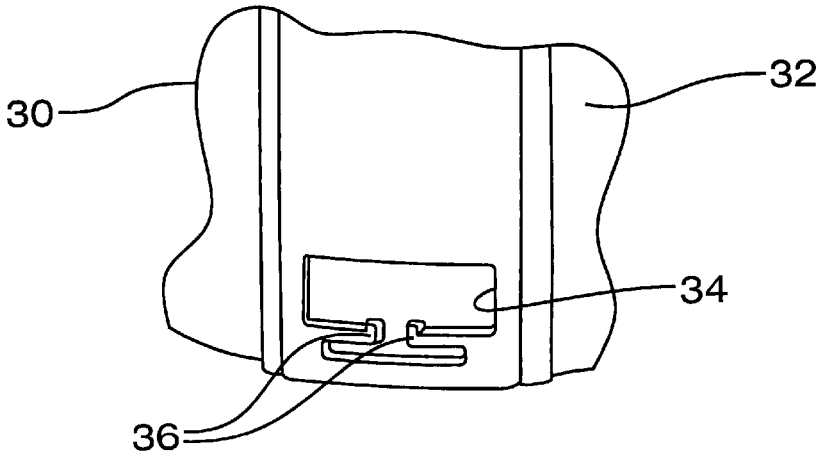
FIG. 6 is a partial perspective view of a bottom portion of the isolation housing of the fuel pump isolation assembly of FIG. 1.
Figure 7:
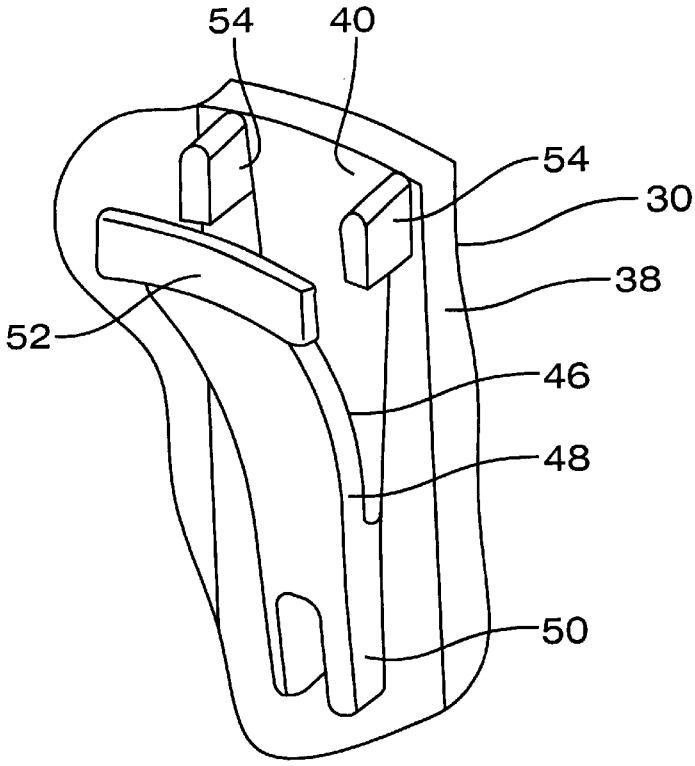
FIG. 7 is a partial perspective view of a flex arm of the isolation housing of the fuel pump isolation assembly of FIG. 1.
Figure 8:
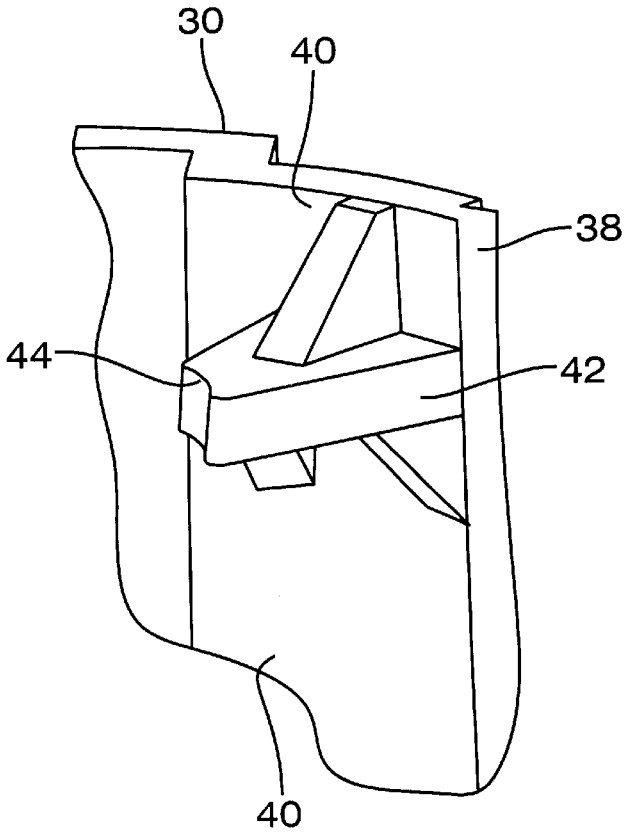
FIG. 8 is a partial perspective view of a pump retention tab of the isolation housing of the fuel pump isolation assembly of FIG. 1.
Figure 9:
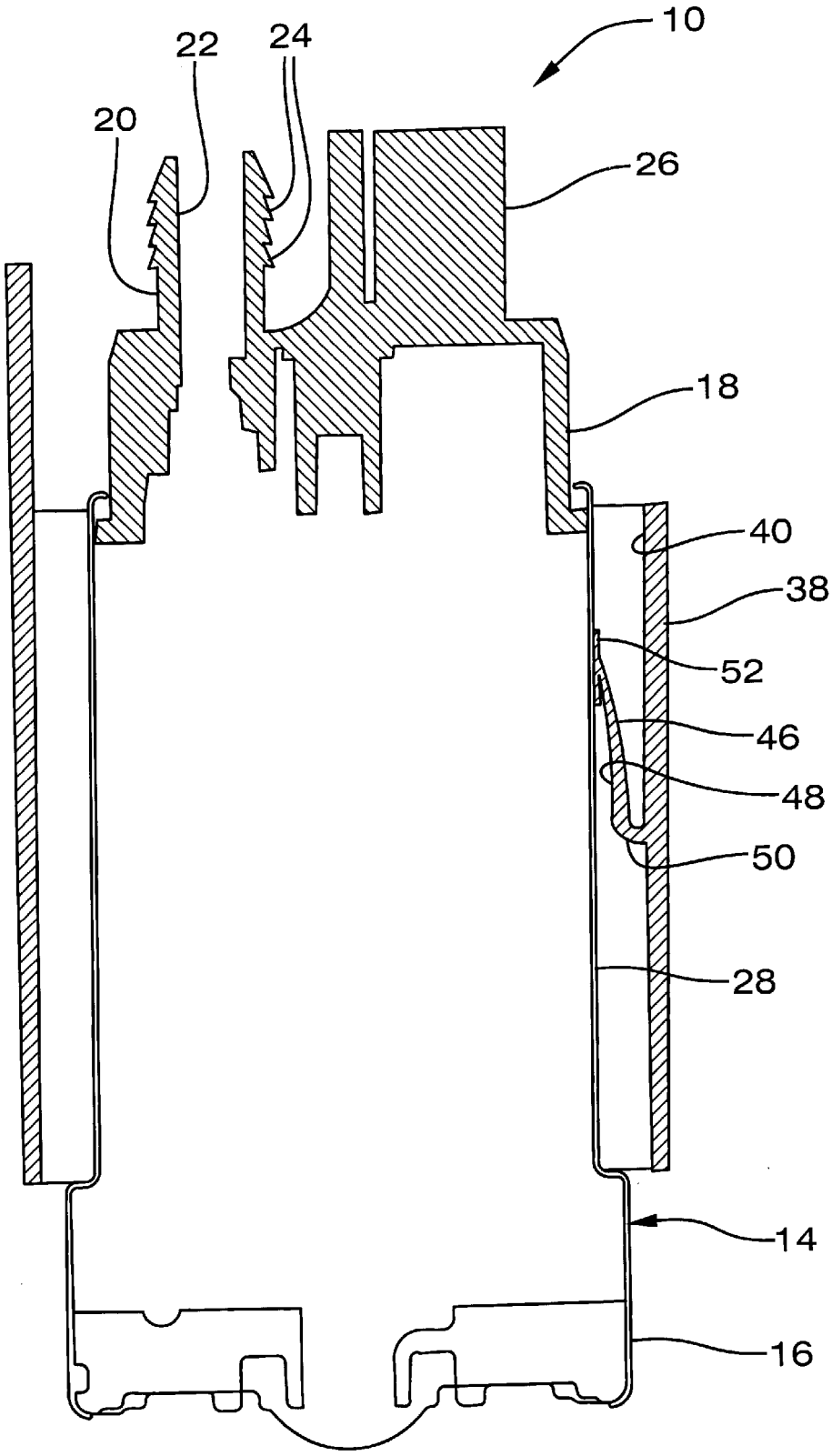
FIG. 9 is a fragmentary elevational view of the fuel pump isolation assembly of FIG. 1.

Referring to FIGS. 4 and 9, the fuel pump isolation assembly 10 includes a fuel pump, generally indicated at 14, to pump fuel from the fuel tank 12 to an engine (not shown) of the vehicle. The fuel pump 14 includes a pump section 16 (partially shown) at one axial end, a motor section (not shown) adjacent the pump section 16 and an outlet section 18 adjacent the motor section at the other axial end. As known in the art, fuel enters the pump section 14, which is rotated by the motor section, and is pumped past the motor section to the outlet section 18. The outlet section 18 has an outlet member 20 extending axially with a passageway 22 extending axially therethrough. The outlet member 20 also has a plurality of projections or barbs 24 extending radially outwardly for attachment to a conduit (not shown). The outlet member 20 also includes a check valve (not shown) disposed in the passageway 22. The outlet member 20 also includes an electrical connector 26 for electrical connection to the motor section and to a source of power (not shown). The pump section 16, motor section, and outlet section 18 are at least partially enclosed by a housing 28 and fixed thereto. It should be appreciated that the fuel flowing to the outlet section 18 flows into the outlet member 20 and through the passageway 22 and check valve when open to the conduit. It should also be appreciated that the fuel pump 12 is conventional and known in the art.

Referring to FIGS. 2 through 9, the fuel pump isolation assembly 10 also includes a retainer or an isolation housing 30 for housing and isolating the fuel pump 14 relative to the fuel tank 12. The isolation housing 30 extends axially and is generally cylindrical in shape. The isolation housing 30 includes an annular side wall 32 extending axially. The side wall 32 has a generally circular cross-sectional shape. The side wall 32 has at least one aperture 34 extending diametrically therethrough. The aperture 34 is generally rectangular in shape. The isolation housing 30 includes at least one, preferably a pair of flexible arm members 36 opposing each other and extending from the side wall 32 and into the aperture 34 for a function to be described.

The isolation housing 30 also includes an interior portion 38 extending from the side wall 32 to form a fuel pump cavity 40. The fuel pump cavity 40 extends axially therethough and is generally circular in cross-sectional shape to receive the fuel pump 14. The interior portion 38 may include a pump retention tab 42 extending into the fuel pump cavity 40 to engage the fuel pump 14 and retain the fuel pump 14 in the fuel pump cavity 40. The pump retention tab 42 has an engagement surface 44 is generally arcuate in shape and complementary to an arcuate shape of the outlet member 20 of the fuel pump 14. It should be appreciated that the pump retention tab 42 prevents the fuel pump 14 from axially exiting the fuel pump cavity 40 to ensure that the fuel pump 14 is trapped in the isolation housing 30 so as not to allow it to come up and separate from the fuel strainer 56 to be described.

The interior portion 38 also includes at least one, preferably a plurality of, more preferably three, vertical flex arms 46 extending into the fuel pump cavity 40 to engage the fuel pump 14 and allow radial movement of the fuel pump 14 in the fuel pump cavity 40 during operation. The vertical flex arms 46 are disposed in the fuel pump cavity 40 and spaced equally circumferentially thereabout. Each of the vertical flex arms 46 have an arm portion 48 extending vertically and a connecting portion 50 interconnecting the arm portion 48 and the interior portion 38. Each of the vertical flex arms 46 have an engagement portion 52 connected to the arm portion 48. The engagement portion 52 is generally retangular and arcuate in shape to engage the housing 28 of the fuel pump 14. The interior portion 38 may include at least one, preferably a pair of stops 54 extending radially therefrom and into the fuel pump cavity 40 to limit radial deflection of the vertical flex arms 46. It should be appreciated that the connecting portion 50 allows the arm portion 48 to deflect or flex radially.

The isolation housing 30 further includes an attachment portion 55 connected to the side wall 32 to attach the side wall 32 to a fuel module (not shown). The attachment portion 55 is generally rectangular in shape.

The isolation housing 30 is made of a plastic material and formed by a conventional injection molding process. The isolation housing 30 is a monolithic structure being integral, unitary, and formed as one-piece. It should be appreciated that, to achieve isolation of the fuel pump 14, the isolation housing 30 allows the fuel pump 14 to move both radially and axially.

The fuel pump isolation assembly 10 further includes a fuel strainer 56 to strain contaminants from the fuel in the fuel tank 12 before it reaches the inlet of the fuel pump 14. The fuel strainer 56 has a body portion 58 which is generally cylindrical in shape with a closed end. The body portion 58 is made of a mesh material to strain contaminants in the fuel as the fuel passes through the body portion 58. The fuel strainer 56 also includes a retaining portion 60 at an open end of the body portion 58. The retaining portion 60 is a solid band of material having a generally cylindrical shape. The retaining portion 60 is press-fit onto the fuel pump 14 and snap fits into the isolation housing 30 via the flexible arm members 36. It should be appreciated that the retaining portion 60 has a portion disposed through the aperture 34 and radially outside the flexible arm members 36. It should also be appreciated that the fuel pump 14 is retained in the isolation housing 30 with the fuel strainer 56. It should further be appreciated that the flexible arm members 36 allow axial movement of the fuel pump 14 during its operation.

Figure 10:
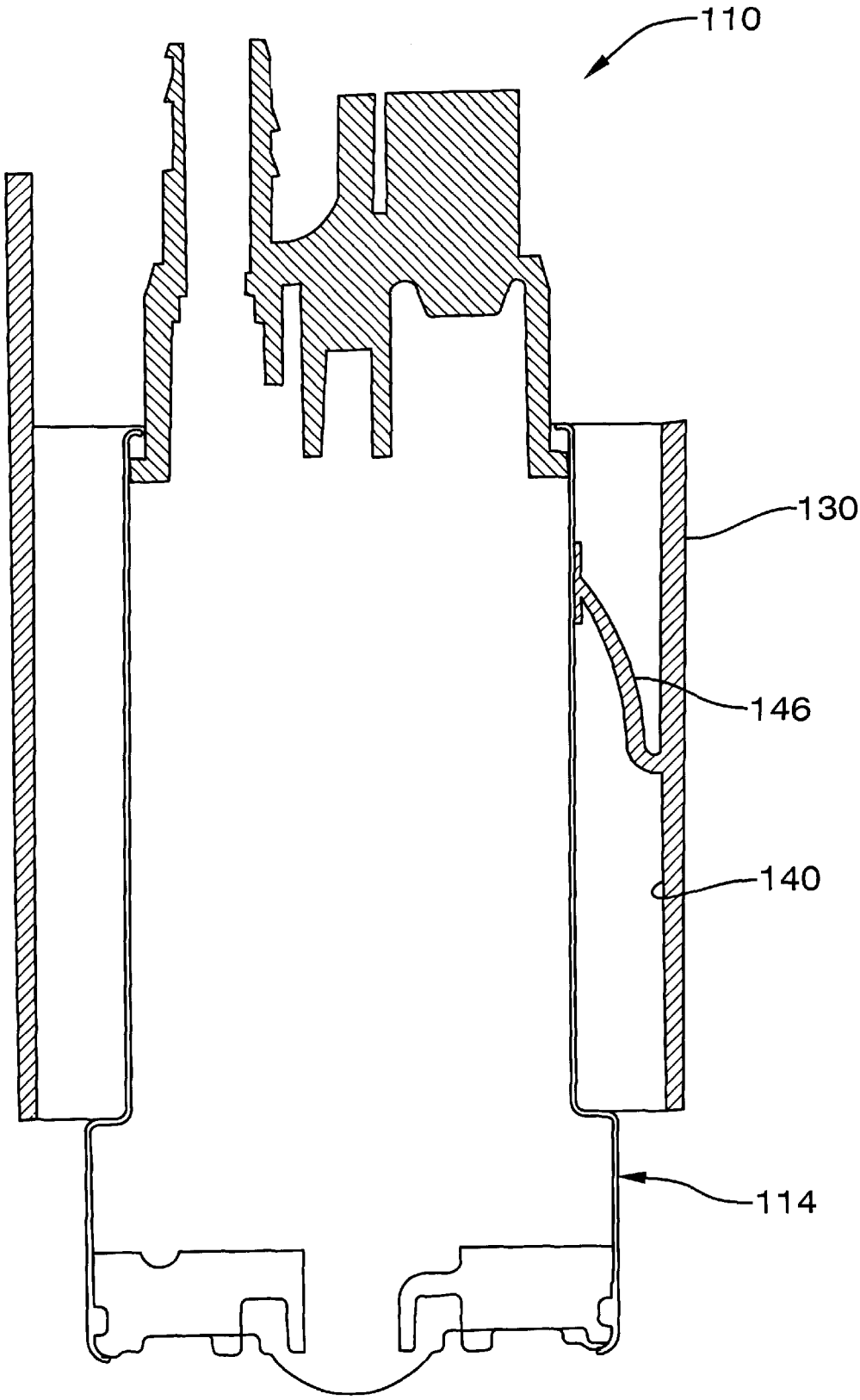
FIG. 10 is a fragmentary elevational view of another embodiment, according to the present invention, of the fuel pump isolation assembly of FIG. 1.

Referring to FIG. 10, another embodiment, according to the present invention, of the fuel pump isolation assembly 10 is shown. Like parts of the fuel pump isolation assembly 10 have like reference numerals increased by one hundred (100). In this embodiment, the fuel pump isolation assembly 110 has the fuel pump 114 of a different diameter, which is less than a diameter of the fuel pump 14. As illustrated, the vertical flex arms 146 extend further into the fuel pump cavity 140 to engage the fuel pump 114. It should be appreciated that the isolation housing 130 is the same housing as the isolation housing 30 to package fuel pumps 14, 114 with different diameters.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A fuel pump isolation assembly comprising:

a fuel pump;

an isolation housing having a fuel pump cavity extending axially therethrough to receive said fuel pump;

a plurality of flex arms each having a lower end extending from said isolation housing to an upper end in said fuel pump cavity to engage an axially extending side of said fuel pump and allow radial and axial movement of said fuel pump during its operation; and a fuel strainer connected to said fuel pump and having a portion engaging a portion of said isolation housing to retain said fuel pump in said fuel pump cavity of said isolation housing.

2. A fuel pump isolation assembly as set forth in claim 1 including a pump retention tab extending from said isolation housing and into said fuel pump cavity to prevent said fuel pump from exiting said fuel pump cavity.

3. A fuel pump isolation assembly as set forth in claim 1 wherein said isolation housing includes an annular side wall extending axially.

4. A fuel pump isolation assembly as set forth in claim 1 wherein each of said flex arms comprises an arm portion extending axially into said fuel pump cavity and a connecting portion interconnecting said arm portion and said isolation housing.

5. A fuel pump isolation assembly as set forth in claim 4 wherein each of said flex arms further comprises an engagement portion connected to said arm portion and engaging said fuel pump.

6. A fuel pump isolation assembly as set forth in claim 5 wherein said engagement portion has an arcuate shape complementary to an arcuate shape of said fuel pump.

7. A fuel pump isolation assembly as set forth in claim 1 wherein said flex arms are spaced equally circumferentially about said fuel pump cavity.

8. A fuel pump isolation assembly for a fuel tank of a vehicle comprising:

a fuel pump;

an isolation housing having a fuel pump cavity extending axially therethrough to receive said fuel pump;

a plurality of flex arms extending from said isolation housing and into said fuel pump cavity to engage said fuel pump and allow radial movement of said fuel pump during its operation; and wherein said side wall includes at least one aperture extending diametrically therethrough.

9. A fuel pump isolation assembly as set forth in claim 8 including a pair of opposing flexible arm members extending from said side wall and into said aperture.

10. A fuel pump isolation assembly as set forth in claim 9 including a fuel strainer connected to an inlet of said fuel pump and extending through said aperture between said flexible arm members and said side wall.

11. A fuel pump isolation assembly for a fuel tank of a vehicle comprising:

a fuel pump;

an isolation housing extending axially having a fuel pump cavity extending axially therethrough to receive said fuel pump;

a plurality of flex arms extending from said isolation housing and into said fuel pump cavity to engage said fuel pump and allow radial movement of said fuel pump during its operation; and a fuel strainer connected to said fuel pump and having a portion engaging said isolation housing to retain said fuel pump in said isolation housing and allow axial movement of said fuel pump during its operation.

12. A fuel pump isolation assembly as set forth in claim 11 wherein said isolation housing includes an annular side wall extending axially.

13. A fuel pump isolation assembly as set forth in claim 11 including a pump retention tab extending from said isolation housing and into said fuel pump cavity to prevent said fuel pump from exiting said fuel pump cavity.

14. A fuel pump isolation assembly as set forth in claim 11 wherein each of said flex arms comprises an arm portion extending axially into said fuel pump cavity and a connecting portion interconnecting said arm portion and said isolation housing.

15. A fuel pump isolation assembly as set forth in claim 14 wherein each of said flex arms further comprises an engagement portion connected to said arm portion and engaging said fuel pump.

16. A fuel pump isolation assembly as set forth in claim 11 wherein said flex arms are spaced equally circumferentially about said fuel pump cavity.

17. A fuel pump isolation assembly for a fuel tank of a vehicle comprising:

a fuel pump;

an isolation housing extending axially having a fuel pump cavity extending axially therethrough to receive said fuel pump;

a plurality of flex arms extending from said isolation housing and into said fuel pump cavity to engage said fuel pump and allow radial movement of said fuel pump during its operation;

a fuel strainer connected to said fuel pump and cooperating with said isolation housing to allow axial movement of said fuel pump during its operation; and wherein said side wall includes at least one aperture extending diametrically therethrough.

18. A fuel pump isolation assembly as set forth in claim 17 including a pair of opposing flexible arm members extending from said side wall and into said aperture, said fuel strainer being connected to an inlet of said fuel pump and extending through said aperture between said flexible arm members and said side wall.

19. A fuel tank assembly for a vehicle comprising:

a fuel tank;

a fuel pump;

an isolation housing having a fuel pump cavity extending axially therethrough to receive said fuel pump;

a plurality of flex arms extending from said isolation housing and into said fuel pump cavity to engage said fuel pump and allow radial movement of said fuel pump during its operation; and a fuel strainer connected to said fuel pump and having a portion engaging said isolation housing to retain said fuel pump in said isolation housing and allow axial movement of said fuel pump during its operation.

* * * * *